US011712137B1

(12) United States Patent
Lu

(10) Patent No.: US 11,712,137 B1
(45) Date of Patent: Aug. 1, 2023

(54) REUSABLE FIXED TISSUE HOLDER

(71) Applicant: Tongxiang Cochlea Supply Chain Management Co., Ltd., Jiaxing (CN)

(72) Inventor: Xiangyu Lu, Taizhou (CN)

(73) Assignee: Tongxiang Cochlea Supply Chain Management Co., Ltd., Jiaxing (CN)

( * ) Notice: Subject to any disclaimer, the term of this patent is extended or adjusted under 35 U.S.C. 154(b) by 0 days.

(21) Appl. No.: 17/713,245

(22) Filed: Apr. 5, 2022

(30) Foreign Application Priority Data

Mar. 17, 2022 (CN) ..... 202210262588.2

(51) Int. Cl.
*A47K 10/38* (2006.01)

(52) U.S. Cl.
CPC .. *A47K 10/3836* (2013.01); *A47K 2010/3863* (2013.01)

(58) Field of Classification Search
CPC ..... A47K 10/38; A47K 10/3836; A47K 2010/3863
See application file for complete search history.

(56) References Cited

U.S. PATENT DOCUMENTS 3,240,461 A * 3/1966 Singleton ..... F16B 47/00 248/314
4,012,007 A * 3/1977 Cunningham ..... A47K 10/3836 248/205.8
4,593,947 A * 6/1986 Yocum ..... B65G 47/91 294/187
5,297,750 A * 3/1994 Hunt ..... B65H 35/002 242/422.4
6,405,973 B1 * 6/2002 Hollinger ..... A47K 10/38 242/591
6,776,368 B1 * 8/2004 Duncan ..... A47K 10/3836 242/597.7
6,837,852 B2 * 1/2005 Wu ..... A61B 17/0206 604/35
7,264,197 B2 * 9/2007 Yu ..... A47K 10/3836 242/591
7,458,541 B1 * 12/2008 Chang ..... A47K 10/3836 248/205.8
10,753,384 B1 * 8/2020 Chang ..... F16B 47/00
(Continued)

FOREIGN PATENT DOCUMENTS

CN 103101795 A 5/2013
CN 107280559 A 10/2017
CN 109689547 A 4/2019

*Primary Examiner* — William A. Rivera
(74) *Attorney, Agent, or Firm* — Nitin Kaushik

(57) ABSTRACT

The present invention relates to the technical field of furniture items, in particular to a reusable fixed tissue holder including: a bar frame including a first bar frame and a second bar frame sleeving the first bar frame; a base fixed to one end of the first bar frame; a disc seat mounted in the base; a sucking disc body mounted on the disc seat, wherein a first channel is disposed on the disc seat, and a second channel connected with the channel is disposed on the sucking disc body; and a button structure mounted on the base and used for connecting the first channel and the second channel to the outer atmosphere. According to the present invention, a cavity is exhausted by using a pipe barrel to form a negative pressure, the tissue holder can be adsorbed on the wall surface without applying a great pressing force.

9 Claims, 8 Drawing Sheets

(56) References Cited

U.S. PATENT DOCUMENTS

| | | | | |
|---|---|---|---|---|
| 11,391,754 | B1 * | 7/2022 | Gilday | G01P 5/165 |
| 2006/0284001 | A1 * | 12/2006 | Paradise | A47K 10/3836<br>242/597.7 |

* cited by examiner

REUSABLE FIXED TISSUE HOLDER

CROSS-REFERENCE TO RELATED APPLICATIONS

The application claims priority to Chinese patent application No. 202210262588.2, filed on Mar. 17, 2022, the entire contents of which are incorporated herein by reference.

TECHNICAL FIELD

The present invention relates to the technical field of furniture items, in particular to a reusable fixed tissue holder.

BACKGROUND

A toilet roll and a tissue are common items in our life. A tissue holder formed by making a housing of plastic or metal material, disposing a shaft on a base, sleeving the shaft with a middle circular hole of a tissue roll and internally placing or laying a container for placing toilet roll or folding paper is used on private or public occasions such as homes, hotels, bathrooms, toilets, public places and entertainment venues. During use, firstly, the tissue holder is generally fixed by bolt locking or double-sided adhesive tape attachment and is then sleeved by the toilet roll, and the next section of toilet roll needs to be torn down when being used. However, by using such two fixing manners, use occasions of the tissue holder will be limited, it is impossible to appropriately change a mounting position according to a use demand, moreover, once the tissue holder is to be dismounted from the original position, a wall structure on the mounting position will be inevitably destroyed, and therefore, it is very difficult to consider the two fixing manners as ideal fixing manners.

In order to solve the above-mentioned problems, a multipurpose tissue holder disclosed in a patent with the patent No. CN200920002764.9, a tissue holder with a sucking disc disclosed in a patent with the patent No. CN201922455866.2, a tissue holder capable of more stably holding tissues disclosed in a patent with the patent No. CN202010878374.9 and a sucking-disc-type tissue holder disclosed in a patent with the patent No. CN201120532318.6 are all adsorbed on a mounting wall surface by using a sucking disc, so that it is possible that the tissue holder is mounted on other places after being dismounted. However, found by researching solutions disclosed as above, due to characteristics of the sucking disc, the sucking disc needs to be vigorously squeezed to be adsorbed on a smooth wall surface when being used, however, the tissue holder cannot be better fixed except that a gas between the sucking disc and the wall surface is exhausted to form a negative pressure during pressurization. However, since the tissue holder requires higher adsorption capacity, generally, the sucking disc cannot be undersized, or else, the tissue holder cannot be effectively borne. During squeezing, on one hand, a certain effort has to be spent, and it is possible that the tissue holder needs to be repeatedly squeezed to be fixed; on the other hand, different squeezing forces are required for fixing sucking discs with different sizes; moreover, it is also very difficult to take down the tissue holder which has been fixed due to the adsorption capacity of the sucking disc. Therefore, as a whole, the efficiency of fixing the sucking disc on a wall body or dismounting the sucking disc from the wall body should be further increased.

SUMMARY

The purpose of the present invention is to provide a reusable fixed tissue holder for solving the problem proposed in the above-mentioned background art.

In order to achieve the above-mentioned purpose, the present invention provides the following technical solution:

provided is a reusable fixed tissue holder including:

a bar frame comprising a first bar frame and a second bar frame sleeving the first bar frame;

a base fixed to one end of the first bar frame;

a disc seat mounted in the base;

a sucking disc body mounted on the disc seat, wherein a first channel is disposed on the disc seat, and a second channel connected with the channel is disposed on the sucking disc body; and a button structure mounted on the base and used for connecting the first channel and the second channel to the outer atmosphere.

Further, the tissue holder comprising a structure for exhausting a gas between the sucking disc body and a smooth surface when the sucking disc body is adsorbed on the smooth surface.

Further, the structure comprises an open pipe barrel and a rubber plug matched with the pipe barrel; the pipe barrel is connected with the second channel by a pipeline on which a one-way valve is disposed; and by pressing the second bar frame, the pipe barrel generates a negative pressure between the sucking disc body and the smooth surface by virtue of the second channel.

Further, the inside of the first bar frame is hollow, the second bar frame is movably inserted to the first bar frame; the pipe barrel is mounted in the first bar frame; and the second bar frame makes the pipe barrel generate a negative pressure by virtue of a linkage mechanism.

Further, the linkage mechanism comprises a first rack, a second rack and a gear; one end of the first rack is connected with the bottom end of the second bar frame, and the other end of the first rack is engaged with the gear mounted in the first bar frame; and one end of the second rack is engaged with the gear, and the other end of the second rack is connected with the rubber plug.

Further, a sliding chute is formed in the inner wall of the first bar frame; a sliding block of the second bar frame is slidably connected with the sliding chute; a supporting bar is mounted on the second rack located outside the pipe barrel; the sliding block of the supporting bar is slidably connected with the sliding chute; an exhaust hole is reserved in the bottom of the pipe barrel; and one end of a plug lid passes through the first bar frame to plug up the exhaust hole.

Further, a push bar is connected to the bottom end of the second bar frame; the bottom end of the push bar is connected with the top end of the pipe barrel; the inside of the first bar frame is hollow; the pipe barrel is mounted in the first bar frame; and one end of a fulcrum bar with a channel is connected with the rubber plug, and the other end of the fulcrum bar is fixed to the inner wall of the first bar frame.

Further, through holes connected with the channel are formed in upper and lower ends of the fulcrum bar, the through hole formed in the upper end is located in the pipe barrel, and the through hole formed in the lower end is connected with the pipeline; an exhaust hole connected with the channel is reserved in the bottom of the fulcrum bar; and one end of the plug lid passes through the first bar frame to plug up the exhaust hole.

Further, the button structure comprises a button mounted on the side end surface of the base; an elastic element is disposed between the button and the base; the disc seat is connected with a connecting part mounted in the base and the connecting part is provided with a through groove which is provided with a groove opening; the button is equipped with a convex pressing block of which the diameter is slightly smaller than the internal diameter of the through groove, that is, air can enter the first channel through the groove opening; and the pressing block is located in the through groove and is used for plugging up the groove opening at the initial time.

Further, the button structure comprises a button mounted on the upper end surface of the base; the disc seat is connected with a connecting part mounted in the base, and the connecting part is provided with a through groove; the button is provided with a strip-shaped pressing block passing through the base and the connecting part; the pressing block located in the through groove is equipped with an elastic element; the pressing block is provided with a [-shaped channel; an anti-drop block is disposed on the bottom of the pressing block; and an opening in the upper end of the [-shaped channel is connected with the outer atmosphere at the initial time, and an opening at the lower end of the [-shaped channel is sealed together with the inner wall of the connecting part so that the through groove is not connected with the outer atmosphere.

Further, a cavity is disposed between the top of the sucking disc body and the disc seat, the first channel and the second channel are connected with the cavity, the disc seat is provided with a convex sealing ring, and a ring groove adapted to the convex sealing ring is formed in the sucking disc body.

Compared with the prior art, the present invention has the following beneficial effects.

According to the present invention, the cavity is exhausted by using the pipe barrel to form a negative pressure, then, a negative pressure can be rapidly achieved between the sucking disc body and a wall surface to be adsorbed and fixed thereto, and thus, the tissue holder can be adsorbed on the wall surface without applying a great pressing force. Moreover, by using the active negative pressure, not only can the sucking disc body be rapidly adsorbed, but also the purposes of adsorption and fixation can be achieved by the least pressing number of times. Meanwhile, the air in a region between the sucking disc body and the wall surface can be evacuated as much as possible to form vacuum, so that the adsorption capacity is high, the adsorption and fixation effects are better, and both time and effort are saved when the sucking disc body is adsorbed and fixed. By using the reusable fixed tissue holder, the problem that the tissue holder is easily upset and cannot be repeatedly fixed or used is solved. The purpose that the tissue holder is easily fixed, is then easily unfixed and is fixed on other places so as to be reused is achieved.

DETAILED DESCRIPTION OF THE EMBODIMENTS

Embodiment 1

Figure 1:
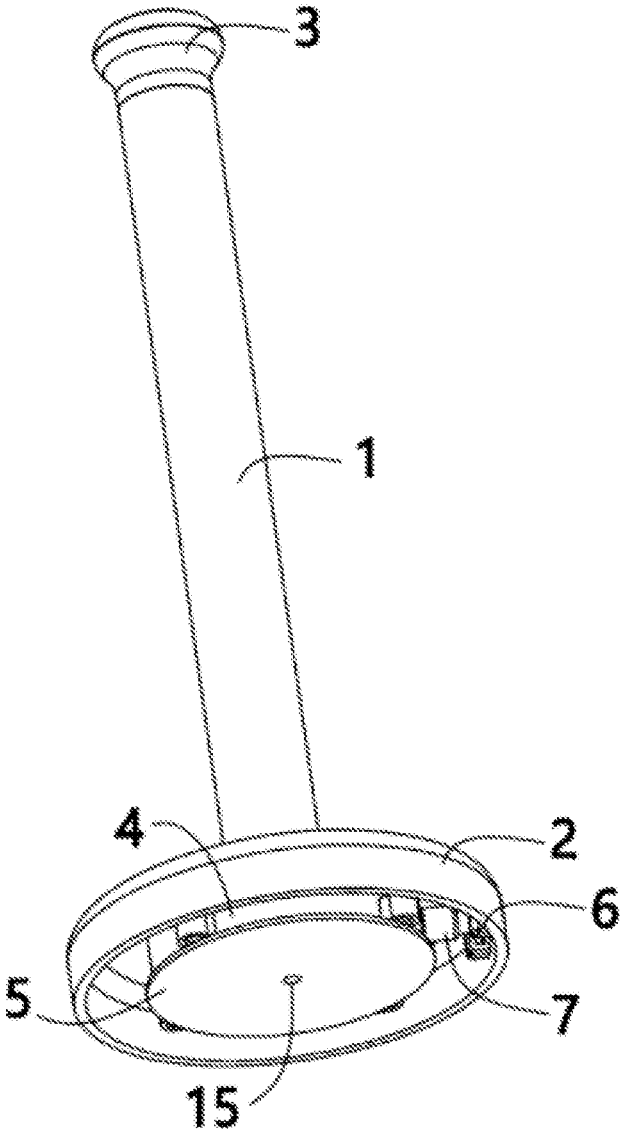
FIG. 1 is a schematic diagram showing a structure of the present invention.
Figure 2:
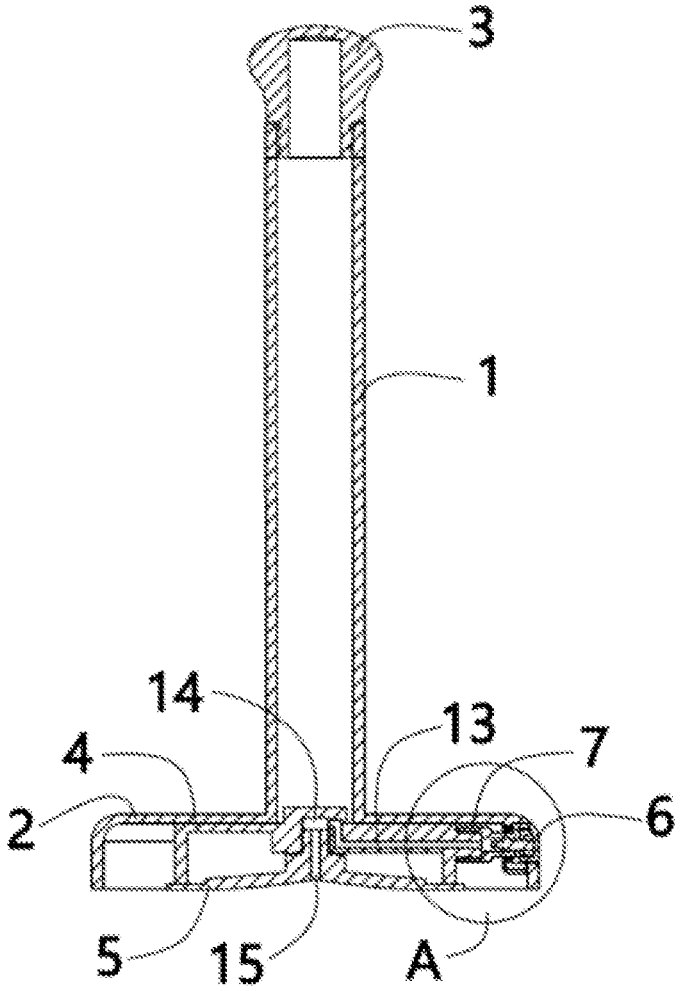
FIG. 2 is a first schematic diagram showing a longitudinal section structure in FIG. 1 of the present invention.
Figure 3:
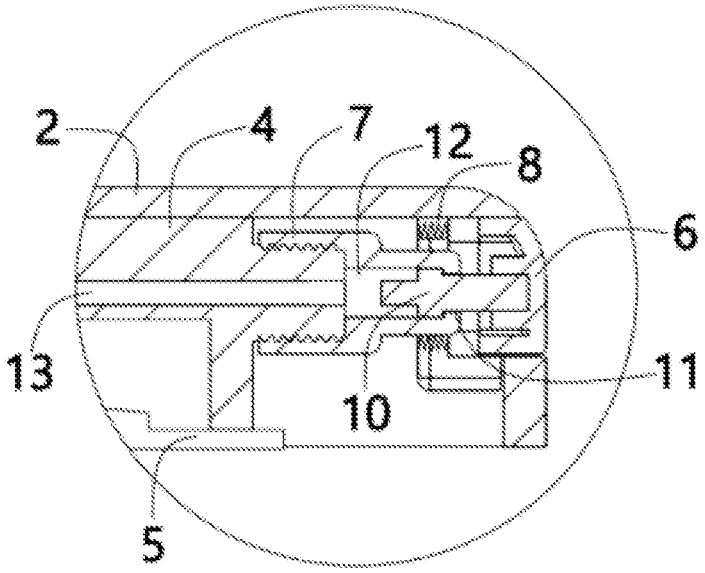
FIG. 3 is a schematic diagram showing an enlarged structure of a detail A in FIG. 1 of the present invention.

Reference is made to FIG. 1 to FIG. 3, the present invention provides a technical solution:

provided is a reusable fixed tissue holder including:

a bar frame including a first bar frame 1 and a second bar frame 3 sleeving the first bar frame 1;

a base 2 fixed to one end of the first bar frame 1;

a disc seat 4 mounted in the base 2;

a sucking disc body 5 mounted on the disc seat 4, wherein a first channel 13 is disposed on the disc seat 4, and a second channel 15 connected with the channel 13 is disposed on the sucking disc body 5; and a button structure mounted on the base 2 and used for connecting the first channel 13 and the second channel 15 to the outer atmosphere.

Specifically, the reusable fixed tissue holder further includes a structure for exhausting a gas between the sucking disc body 5 and a smooth surface when the sucking disc body 5 is adsorbed on the smooth surface.

Specifically, the button structure includes a button 6 mounted on the side end surface of the base 2; an elastic element 8 is disposed between the button 6 and the base 2; the disc seat 4 is connected with a connecting part 7 mounted in the base 2, and the connecting part 7 is provided with a through groove 12 which is provided with a groove opening 11; the button 6 is equipped with a convex pressing block 10 of which the diameter is slightly smaller than the internal diameter of the through groove 12, that is, air can enter the first channel 13 through the groove opening 11; and the pressing block 10 is located in the through groove 12 and is used for plugging up the groove opening 11 at the initial time.

Specifically, a cavity 14 is disposed between the top of the sucking disc body 5 and the disc seat 4, the first channel 13 and the second channel 15 are connected with the cavity 14, the disc seat 4 is provided with a convex sealing ring 28, and a ring groove 27 adapted to the convex sealing ring 28 is formed in the sucking disc body 5.

In the present embodiment, during use, all the parts are mounted firstly, and then, the second bar frame 3 is pressed so that the sucking disc body 5 mounted on the bottom of the disc seat 4 can be adsorbed on the smooth surface such as a wall surface. At the initial time, the convex pressing block 10 on the button 6 may plug up the groove opening 11 under the action of the elastic element 8, so that the through groove 12 may not be connected with the outer atmosphere. In this way, the second channel 15 of the sucking disc body 5 is prevented from being connected with the through groove 12. It can be ensured that the negative pressure between the sucking disc body and the wall surface is in a good state after the tissue holder is fixed to the smooth wall surface, so that the overall tissue holder can be very firm and cannot be easily upset when the sucking disc body is sucked. If the tissue holder needs to be moved, that is, if the tissue holder needs to be dismounted from an original position and mounted on other wall surface structures, the button 6 of the base 2 is pressed down to cause the second channel 15 to be connected with the outer atmosphere after passing through the first channel 13 and the through groove 12, in this way, the sucking disc body 5 loses a suction force, the overall tissue holder may easily move, when the tissue holder is placed on a target place again, the button 6 is pressed down again, and thus, the sucking disc body 5 can be firmly fixed again.

Figure 5:
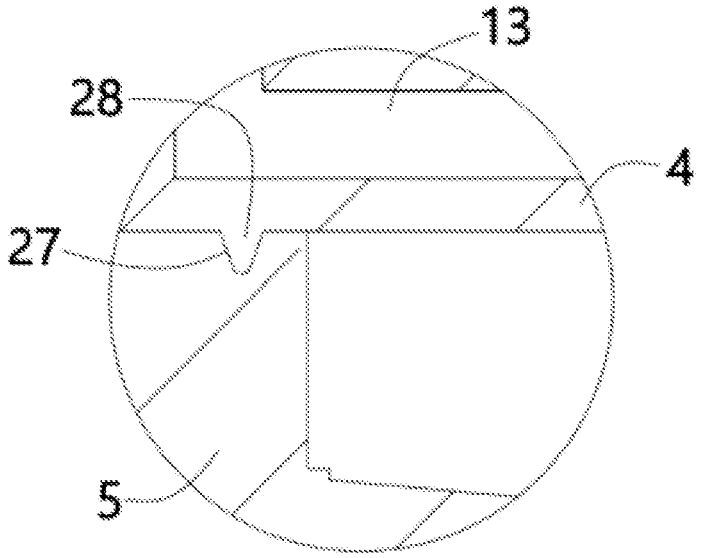
FIG. 5 is a schematic diagram showing an enlarged structure of a detail B in FIG. 4 of the present invention.

In the present embodiment, as shown in FIG. 5, by prefabricating the convex sealing ring 28 on the disc seat 4 and reserving the ring groove 27 on the sucking disc body 5, the convex sealing ring 28 may be tightly attached to the ring groove 27 after the sucking disc body 5 and the disc seat 4 are mounted, so that the sealing property of the sucking disc body 5 (the second channel 15) and the outer atmosphere (the first channel 13) can be improved.

In the present embodiment, when being released, the button 6 is turned off to block the flow of air, so that the sucking disc body 5 is fixed; and when being pressed down, the button 6 is turned on to achieve the flow of the air, so that the sucking disc body 5 is unlocked. The button 6 controls the first channel 13 to be connected with the bottom of the sucking disc body 5 (the second channel 15), and thus, if the button is turned on, the flow of the air is achieved, and the sucking disc body 5 is unlocked. That is, if the button is turned on, the flow of the air is achieved, and the sucking disc body 5 is rapidly unlocked.

In the present embodiment, the size of the overall tissue holder, sizes of the parts and the like can be set according to actual use conditions. For example, the internal diameter of the first channel 13 and the internal diameter of the second channel 15 can be set according to adsorption capacity. Again for example, the elastic element 8 may adopt a reset spring, the bar frame may be made of stainless steel or PVC, the convex sealing ring 28 may be made of the same material as the sucking disc body 5, they can be flexibly selected according to specific conditions, the descriptions thereof are omitted herein.

Embodiment 2

Figure 4:
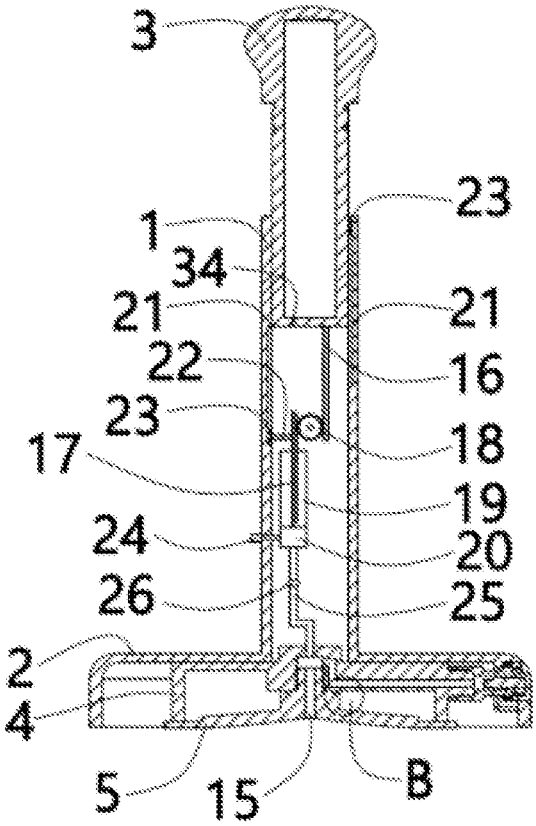
FIG. 4 is a second schematic diagram showing the longitudinal section structure in FIG. 1 of the present invention.

Reference is made to FIG. 4, the structure in the present embodiment is basically same as the structure in the embodiment 1, except that:

the structure includes an open pipe barrel 19 and a rubber plug 20 matched with the pipe barrel 19; the pipe barrel 19 is connected with the second channel 15 by a pipeline 25 on which a one-way valve 26 is disposed; and by pressing the second bar frame 3, the pipe barrel 19 generates a negative pressure between the sucking disc body 5 and the smooth surface by virtue of the second channel 15. The inside of the first bar frame 1 is hollow; the second bar frame 3 is movably inserted to the first bar frame 1; the pipe barrel 19 is mounted in the first bar frame 1; and the second bar frame 3 makes the pipe barrel 19 generate a negative pressure by virtue of a linkage mechanism. The linkage mechanism includes a first rack 16, a second rack 17 and a gear 18; one end of the first rack 16 is connected with the bottom end of the second bar frame 3, and the other end of the first rack 16 is engaged with the gear 18 mounted in the first bar frame 1; and one end of the second rack 17 is engaged with the gear 18, and the other end of the second rack 17 is connected with the rubber plug 20. A sliding chute 21 is formed in the inner wall of the first bar frame 1, a sliding block 23 of the second bar frame 3 is slidably connected with the sliding chute 21; a supporting bar 22 is mounted on the second rack 17 located outside the pipe barrel 19; the sliding block 23 of the supporting bar 22 is slidably connected with the sliding chute 21; an exhaust hole (unshown in the figure) is reserved in the bottom of the pipe barrel 19; and one end of a plug lid 24 passes through the first bar frame 1 to plug up the exhaust hole.

In the present embodiment, the purpose of rapidly unlocking the sucking disc body 5 in the above-mentioned embodiment 1 can be achieved. In addition, by additionally providing the linkage mechanism, the tissue holder may be pressed on a wall body, so that the effort is saved, and adsorption and fixation to the smooth wall surface can be more rapidly achieved without pressing for an overlarge number of times within the same time, that is, the fixation efficiency of the sucking disc body 5 is higher.

In the present embodiment, the first bar frame 1 and the second bar frame 3 are set to relatively slide, that is, the second bar frame 3 may slide along the first bar frame 1 by pressing the head of the second bar frame 3 during pressing.

In the present embodiment, as shown in FIG. 4, during special use, firstly, the head of the second bar frame 3 is pressed, in this way, the bottom end of the second bar frame 3 drives the first rack 16 to make the gear 18 rotate, the gear 18 is engaged with the second rack 17, then, the rubber plug 20 is uplifted by the second rack 17, the cavity 14 is exhausted by virtue of the pipe barrel 19 to form a negative pressure, and then, a negative pressure can be rapidly achieved between the sucking disc body 5 and a wall surface to be adsorbed and fixed thereto, and thus, the tissue holder can be adsorbed on the wall surface without applying a great pressing force. Moreover, by using the active negative pressure, not only can the sucking disc body 5 be rapidly adsorbed, but also the purposes of adsorption and fixation can be achieved by the least pressing number of times. Meanwhile, the air in a region between the sucking disc body and the wall surface can be evacuated as much as possible to form vacuum, so that the adsorption capacity is high, the adsorption and fixation effects are better, and as a whole, both time and effort are saved during adsorption and fixation. The purpose of adsorbing the sucking disc body 5 is achieved by virtue of the negative pressure generated by the linkage mechanism, and thus, the effects of adsorbing and fixing the tissue holder on the wall surface cannot be limited by a different size of the sucking disc body 5.

In the present embodiment, in order to ensure the sliding of the second bar frame 3 on the first bar frame 1 and the stability that the second rack 17 drives the rubber plug 20 to run, the sliding chute 21 is formed in the inner wall of the first bar frame 1, and then, the corresponding sliding block 23 is slidably matched with the sliding chute 21, so that the above-mentioned stability is achieved.

In the present embodiment, when the sucking disc is dismounted, as mentioned in the above-mentioned embodiment 1, the button 6 is only pressed. Then, the plug lid 24 is pulled out, then, the second bar frame 3 is upwards pulled relative to the first bar frame 1, and thus, reset is achieved. After reset, the plug lid 24 is plugged again. An insertion hole 34 allowing the top end of the second rack 17 to be inserted is formed in the bottom of the second bar frame 3, so that the first rack 16, the gear 18, the second rack 17 and the like may be normally linked when being pressed by the second bar frame 3.

Embodiment 3

Figure 6:
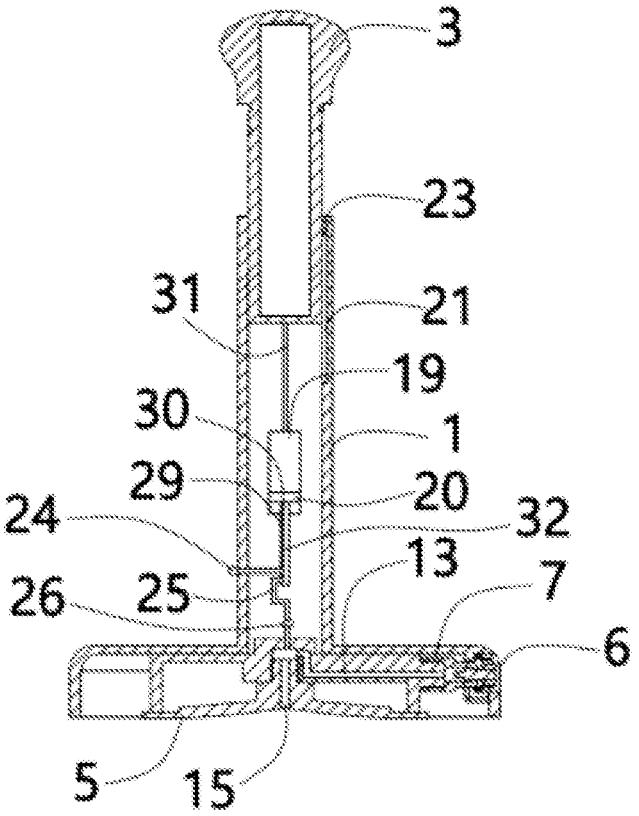
FIG. 6 is a third schematic diagram showing the longitudinal section structure in FIG. 1 of the present invention.

Reference is made to FIG. 6, the structure in the present embodiment is basically same as the structure in the embodiment 2, except that:

a push bar 31 is connected to the bottom end of the second bar frame 3; the bottom end of the push bar 31 is connected with the top end of the pipe barrel 19; the inside of the first bar frame 1 is hollow; the pipe barrel 19 is mounted in the first bar frame 1; and one end of a fulcrum bar 29 with a third channel 32 is connected with the rubber plug 20, and the other end of the fulcrum bar 29 is fixed to the inner wall of the first bar frame 1.

Specifically, through holes 30 connected with the third channel 32 are formed in upper and lower ends of the fulcrum bar 29, the through hole 30 formed in the upper end is located in the pipe barrel 9, and the through hole 30 formed in the lower end is connected with the pipeline 25; an exhaust hole connected with the third channel 32 is reserved in the bottom of the fulcrum bar 29; and one end of the plug lid 24 passes through the first bar frame 1 to plug up the exhaust hole.

In the present embodiment, the opening of the pipe barrel 19 is downward and is opposite to the opening of the pipe barrel 19 in the embodiment 2. Moreover, in the present embodiment, the pipe barrel 19 may move together with the second bar frame 3 relative to the first bar frame 1, and the fulcrum bar 29 and the rubber plug 20 are fixed relative to the first bar frame 1.

In the present embodiment, during specific use, firstly, the head of the second bar frame 3 is pressed, in this way, the bottom end of the second bar frame 3 drives the push bar 31 to drive the pipe barrel 19 to move downwards, then, air exhaust is achieved, a negative pressure is formed in the cavity 14, and thus, time-saving and effort-saving fixation of the sucking disc body 5 on the wall surface to be adsorbed and fixed can be achieved as that in the above-mentioned embodiment 2.

In the present embodiment, the structure is further simplified as comparison with that in the embodiment 2. Moreover, the plug lid 24 is sealed with the exhaust hole of the inner third channel 32 of the fulcrum bar 29, and therefore, when the sucking disc is dismounted, as mentioned in the above-mentioned embodiment 1, the button 6 only needs to be pressed. Then, the plug lid 24 is pulled out, then, the second bar frame 3 is upwards pulled relative to the first bar frame 1, and thus, reset is achieved. After reset, the plug lid 24 is plugged again.

In the present invention, as mentioned in the above mentioned embodiment 2 and the embodiment 3, the movement distance of the second bar frame 3 may be flexibly set according to a required condition, that is, in the embodiment 2, the second bar frame 3 moves downwards, which may not cause interference to the gear 18 and the second rack 17. The movement of the supporting bar 22 may not cause interference to the pipe barrel 19. In the embodiment 3, the second bar frame 3 moves downwards to drive the pipe barrel 19 to move downwards, which may not cause interference to the plug lid 24, and the rubber plug 20 may not be separated from the opening of the pipe barrel 19 to the outside of the pipe barrel 19, the descriptions thereof are omitted herein.

Embodiment 4

Figure 8:
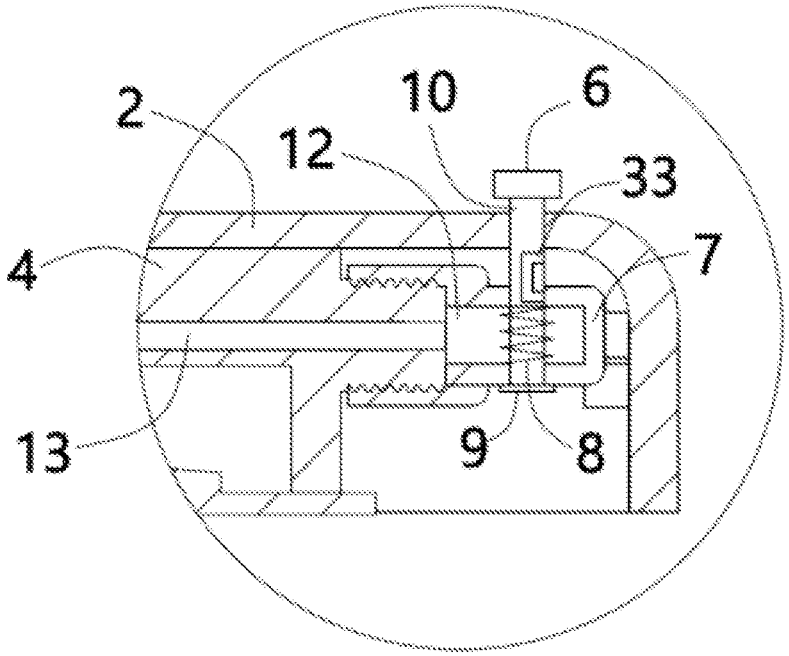
FIG. 8 is a schematic diagram showing an enlarged structure of a detail C in FIG. 7 of the present invention.

Reference is made to FIG. 8, the structure in the present embodiment is basically same as the structure in the embodiment 1, except that:

the button structure includes a button 6 mounted on the upper end surface of the base 2; the disc seat 4 is connected with a connecting part 7 mounted in the base 2, and the connecting part 7 is provided with a through groove 12; the button 6 is provided with a strip-shaped pressing block 10 passing through the base 2 and the connecting part 7; the pressing block 10 located in the through groove 12 is equipped with an elastic element 8; the pressing block 10 is provided with a [-shaped channel 33; an anti-drop block 9 is disposed on the bottom of the pressing block 10; and an opening in the upper end of the [-shaped channel 33 is connected with the outer atmosphere at the initial time, and an opening at the lower end of the [-shaped channel 33 is sealed together with the inner wall of the connecting part 7 so that the through groove 12 is not connected with the outer atmosphere.

In the present embodiment, the mounting position of the button structure is changed from the side end surface of the base 2 in the embodiment 1 to the upper end surface of the base 2. The purpose of such setting is that in combination with the embodiment 2 and the embodiment 3, the button structure is mounted on the side end surface of the base 2, the tissue holder may be pressed on the wall surface by using the linkage mechanism, so that the effort is saved, and the sucking disc body 5 may be adsorbed and fixed to the wall surface to be mounted without pressing for an overlarge number of times. However, when the second bar frame 3 is pressed, the linkage mechanism works, in this process, a negative pressure is formed in the cavity 14; however, after the negative pressure is formed in the cavity 14, the first channel 13 is connected with the through groove 12, and therefore, a force needs to be applied to the elastic element 8 in the negative pressure formation process. However, in order to keep a state that the groove opening 11 of the through groove 12 is plugged up by the pressing block 10, it is necessary to select the elastic element 8 with a reasonable elastic coefficient to resist to an acting force generated by the negative pressure, which may cause a larger elastic coefficient of the elastic element 8, thereby being not beneficial to the pressing of the button 6. Therefore, the mounting position of a mechanism such as the button 6 is changed to the upper end surface of the base 2, in this way, the problem can be avoided.

Figure 7:
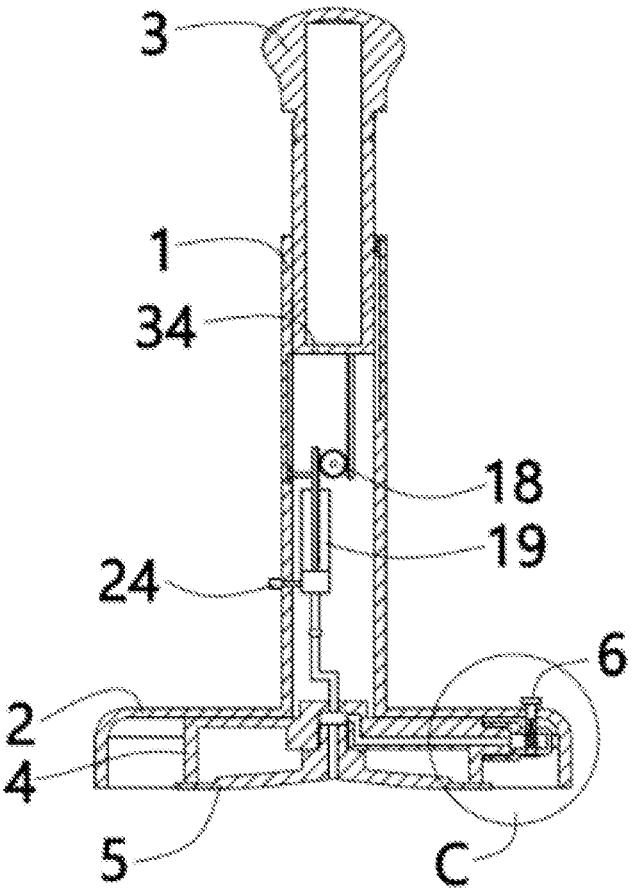
FIG. 7 is a schematic diagram showing another structure of a button structure in FIG. 4 of the present invention.

As shown in FIG. 7, the pressing block 10 moves downwards only when the button 6 is pressed again, which causes the opening in the upper end of the [-shaped channel 33 therein to be located outside the inner wall of the connecting part 7 and the opening in the lower end of the [-shaped channel 33 to be located in the inner wall of the connecting part 7, and thus, the purpose of connecting the through groove 12 to the outer atmosphere can be achieved through the [-shaped channel 33. When the pressing force of the button 6 is removed, the through groove 12 can be isolated again from the outer atmosphere by the elastic element 8 sleeving the pressing block 10 in the through groove 12, so that the tissue holder can be used after being dismounted next time.

What is claimed is:

1. A reusable fixed tissue holder, comprising:

a bar frame comprising a first bar frame (1) and a second bar frame (3) sleeving the first bar frame (1);

a base (2) fixed to one end of the first bar frame (1);

a disc seat (4) mounted in the base (2);

a sucking disc body (5) mounted on the disc seat (4), wherein a first channel (13) is disposed on the disc seat (4), and a second channel (15) connected with the first channel (13) is disposed on the sucking disc body (5); and a button structure mounted on the base (2) and used for connecting the first channel (13) and the second channel (15) to the outer atmosphere;

a structure for exhausting a gas between the sucking disc body (5) and a smooth surface when the sucking disc body (5) is adsorbed on the smooth surface;

wherein the structure comprises an open pipe barrel (19) and a rubber plug (20) matched with the pipe barrel (19); the pipe barrel (19) is connected with the second channel (15) by a pipeline (25) on which a one-way valve (26) is disposed;and by pressing the second bar frame (3), the pipe barrel (19) generates a negative pressure between the sucking disc body (5) and the smooth surface by virtue of the second channel (15).

2. The tissue holder of claim 1, wherein the inside of the first bar frame (1) is hollow;the second bar frame (3) is movably inserted to the first bar frame (1), the pipe barrel (19) is mounted in the first bar frame (1); and the second bar frame (3) makes the pipe barrel (19) generate a negative pressure by virtue of a linkage mechanism.

3. The tissue holder of claim 2, wherein the linkage mechanism comprises a first rack (16), a second rack (17) and a gear (18); one end of the first rack (16) is connected with the bottom end of the second bar frame (3), and the other end of the first rack (16) is engaged with the gear (18) mounted in the first bar frame (1); and one end of the second rack (17) is engaged with the gear (18), and the other end of the second rack (17) is connected with the rubber plug (20).

4. The tissue holder of claim 3, wherein a sliding chute (21) is formed in the inner wall of the first bar frame (1); a sliding block (23) of the second bar frame (3) is slidably connected with the sliding chute (21); a supporting bar (22) is mounted on the second rack (17) located outside the pipe barrel (19); the sliding block (23) of the supporting bar (22) is slidably connected with the sliding chute (21); an exhaust hole is reserved in the bottom of the pipe barrel (19); and one end of a plug lid (24) passes through the first bar frame (1) to plug up the exhaust hole.

5. The tissue holder of claim 1, wherein a push bar (31) is connected to the bottom end of the second bar frame (3); the bottom end of the push bar (31) is connected with the top end of the pipe barrel (19); the inside of the first bar frame (1) is hollow; the pipe barrel (19) is mounted in the first bar frame (1); and one end of a fulcrum bar (29) with a third channel (32) is connected with the rubber plug (20), and the other end of the fulcrum bar (29) is fixed to the inner wall of the first bar frame (1).

6. The tissue holder of claim 5, wherein through holes (30) connected with the channel (32) are formed in upper and lower ends of the fulcrum bar (29), the through hole (30) formed in the upper end is located in the pipe barrel (9), and the through hole (30) formed in the lower end is connected with the pipeline (25); an exhaust hole connected with the third channel (32) is reserved in the bottom of the fulcrum bar (29); and one end of the plug lid (24) passes through the first bar frame (1) to plug up the exhaust hole.

7. The tissue holder of claim 1, wherein the button structure comprises a button (6) mounted on the side end surface of the base (2); an elastic element (8) is disposed between the button (6) and the base (2); the disc seat (4) is connected with a connecting part (7) mounted in the base (2), and the connecting part (7) is provided with a through groove (12) which is provided with a groove opening (11); the button (6) is equipped with a convex pressing block (10) of which the diameter is slightly smaller than the internal diameter of the through groove (12), that is, air can enter the first channel (13) through the groove opening (11); and the pressing block (10) is located in the through groove (12) and is used for plugging up the groove opening (11) at the initial time.

8. The tissue holder of claim 1, wherein the button structure comprises a button (6) mounted on the upper end surface of the base (2); the disc seat (4) is connected with a connecting part (7) mounted in the base (2), and the connecting part (7) is provided with a through groove (12); the button (6) is provided with a strip-shaped pressing block (10) passing through the base (2) and the connecting part (7); the pressing block (10) located in the through groove (12) is equipped with an elastic element (8); the pressing block (10) is provided with a [-shaped channel (33); an anti-drop block (9) is disposed on the bottom of the pressing block (10); and an opening in the upper end of the [-shaped channel (33) is connected with the outer atmosphere at the initial time, and an opening at the lower end of the [-shaped channel (33) is sealed together with the inner wall of the connecting part (7) so that the through groove (12) is not connected with the outer atmosphere.

9. The tissue holder of claim 1, wherein a cavity (14) is disposed between the top of the sucking disc body (5) and the disc seat (4), the first channel (13) and the second channel (15) are connected with the cavity (14), the disc seat (4) is provided with a convex sealing ring (28), and a ring groove (27) adapted to the convex sealing ring (28) is formed in the sucking disc body (5).

* * * * *